US005464502A

United States Patent [19]

Pease

[11] Patent Number: 5,464,502

[45] Date of Patent: Nov. 7, 1995

[54] ANIONIC SULFONATE SURFACTANTS IN THE WASHING AND PULPING OPERATION

[75] Inventor: Jacqueline K. Pease, Jacksonville, Fla.

[73] Assignee: Betz PaperChem, Inc., Jacksonville, Fla.

[21] Appl. No.: 132,076

[22] Filed: Oct. 5, 1993

[51] Int. Cl.[6] ..... D21C 9/02

[52] U.S. Cl. ..... 162/60; 162/72; 162/75; 162/76; 162/DIG. 3

[58] Field of Search ..... 162/60, 76, 72, 162/75, DIG. 3

[56] References Cited

U.S. PATENT DOCUMENTS

| | | | |
|---|---|---|---|
| 2,049,567 | 8/1936 | Larson et al. | 162/76 |
| 2,072,487 | 3/1937 | Snyder | 162/76 |
| 2,502,330 | 3/1950 | Libby | 162/60 |
| 4,297,164 | 10/1981 | Lee | 162/60 |
| 4,347,100 | 8/1982 | Brucato | 162/76 |
| 4,810,328 | 3/1989 | Freis et al. | 162/60 |
| 5,032,224 | 7/1991 | Ahluwalia | 162/76 |

FOREIGN PATENT DOCUMENTS 1270354 6/1990 Canada .

OTHER PUBLICATIONS

Wilkes et al, "New Surface Active Chemicals", *Paper Trade Journal,* Aug. 17, 1939, pp. 63–66.

Blomberg, L., et al., "Organic Carry–Over in Kraft Pulp and Bleaching Discharges", Proceedings from TAPPI Pulping Conference, pp. 217–226 (1990).

Hise et al., "The Effect of Brown Stock Washing on the Formation of Chlorinated Dioxins and Furans During Bleaching", *TAPPI Journal,* 73(1):185–190 (1990).

Laxen, T., "Dynamic and Physical–Chemical Aspects of Sulphate Pulp Washing", *Pulp and Paper Canada,* 87(4):49–53 (1986).

*Primary Examiner*—Peter Chin

*Attorney, Agent, or Firm*—Alexander D. Ricci; Richard A. Paikoff

[57] ABSTRACT

A method for enhancing pulp washing efficiency is disclosed. An anionic sulfonate surfactant is added within the washing or pulping operation to enhance the removal of lignin and spent cooking chemicals from pulp.

9 Claims, No Drawings

ANIONIC SULFONATE SURFACTANTS IN THE WASHING AND PULPING OPERATION

FIELD OF THE INVENTION

The present invention relates to a method for increasing the efficiency of pulp washing by decreasing the tendency for lignin to remain in the fibrous mat after washing.

BACKGROUND OF THE INVENTION

The manufacture of paper from wood requires many complex steps, including the formation of pulp fiber from wood chips. This process takes place in a digester, where wood chips are cooked at high temperature with sodium sulphide and sodium hydroxide in order to break down and solubilize the lignin, so that it can be separated from the wood pulp. The most prominent by-product of the process is kraft lignin, a complex three-dimensional material based on repeating phenol propane units.

The lignin and spent cooking chemicals are contained in the liquid fraction, often referred to as black liquor, of the brown stock. Additional by-products found in the black liquor include wood pitch and hemicelluloses (low molecular weight polysaccharides). When pine is used, crude tall oil and turpentine become very important by-products.

Following the digester, the black liquor (containing organics, mostly lignin, and inorganic spent cooking chemicals) is separated from the wood pulp in a process commonly known as brown stock washing. Rotary drum washers placed in series are commonly used to wash brown stock. Generally, these drums are made up of different washing zones. The first washing step within a drum is usually dilution/thickening, where the brown stock is diluted with liquid which is cleaner than the liquid within the brown stock. After the stock is thickened on the vacuum drum, a second washing step of displacement is usually conducted. In the displacement phase, liquid which is cleaner than the mat of pulp is applied to the mat surface via showers and pulled through the pulp mat to displace the dirty liquid held within it. Kraft brown stock washing can also be conducted with variations of this washing technique. Other washing methods include pressure washers, which use pressure rather than vacuum, and belt washers, which use displacement.

Brown stock washing is important to the pulp mill operation. Digester cooking chemicals are recovered for reuse during washing. Pulp mills also burn the organics for their heating value. Therefore, the efficient collection of organics from the pulp is very important to an effective pulp mill operation. Bleaching, which Often follows brown stock washing, is more efficient when the brown stock washers remove the most by-product sol ids possible.

The brown stock washing phase is also especially important environmentally. The effluent from bleaching is discharged from the mill; this effluent contains chlorinated organics, which can be toxic. Toxic substances which are currently of concern include dioxins and furans, specifically 2,3,7,8-tetradichlorodibenzo-p-dioxin and 2,3,7,8-tetrachlorodibenzofuran, absorbable organic halogens, and color. Increased organics removal in brown stock washing has been shown to decrease the environmental impact of bleaching.

Brown stock washing is an important aspect of pulp mill operation. Specifically, the washing of organics from pulp is becoming increasingly important. In bleached processes, enhanced organic removal would reduce bleaching chemical consumption, costs, and environmental problems associated with effluent discharge of chlorinated organics. In unbleached processes, enhanced organics removal in washing should decrease runnability problems associated with excess lignin in pulp, such as reduced retention aid performance.

DETAILED DESCRIPTION OF THE INVENTION

The present invention relates to a process for enhancing pulp washing efficiency by decreasing the tendency of lignin to remain with the pulp fraction during washing. In this method, anionic surfactants are added within the washing or pulping operation to enhance the removal of lignin. These surfactants are anionic sulfonate compounds of the following general structure:

$$R—SO_3M$$

where M is H or a water soluble cation such as $Na^+$, $NH_4^+$, $K^+$, $Ca^{2+}$or $Mg^{2+}$. R may be alkyl, aryl or alkylaryl, and may be unsubstituted or substituted (with e.g., hydroxyl groups) and can contain various linkages such as ether, ester, amide or urethane linkages.

Furthermore, a multisulfonate can be used, where the sulfonate groups are separated by alkyl, aryl, or alkylaryl groups which may or may not be substituted and may also contain any of the above linkages.

Preferred compounds include sodium alkyl taurine or alkyl diphenol oxide disulfonate, with alkyl chain lengths of $C_8$–$C_{18}$.

The treatment may be added at any point from the digester to the brown stock washers (and the decker, which is a washer that follows but is usually separated from the brown stock washers) in Kraft, or sulphate systems for both hardwood and softwood. In the digester, the temperature of treatment is from about 200° to 350° F., with a pH of about 12 –13. In the washers, the temperature range of treatment is from about 100°–200° F., with a pH of about 8–13. It is expected that the method of the present invention would also be effective in the washing processes that occur within a bleaching plant.

Treatment levels of from about 0.1 to 1000 parts of anionic sulfonate surfactant per million parts of pulp are expected to be effective. Chemically prepared pulp (e.g., sulphate, sulfite) as well as mechanically and semi-chemically prepared pulp may all benefit from the present invention.

The invention will be further understood by reference to the following examples.

Kraft black liquor and unbleached Kraft pulp were collected from a softwood brown stock washer and mixed so that the pulp constituted 0.75% of the mixture (based on oven dry fiber). The stock was divided into separate samples, and the pH of each sample was adjusted to the desired level. Following an incubation period of 30 minutes at 71° C., the samples were filtered. The absorbance of the filtrate was measured at a wavelength of 700 nm, (chosen to be able to measure the broadest array of concentrations of black liquor with minimal dilution) and the Kappa number of the pulp mat was measured as well.

The absorbance was used to measure the solution color, a high color relating to more lignin remaining in the filtrate. The Kappa number measurement is a well-established test method used in the paper industry to determine the lignin content of pulp. In this method, pulp is bleached with an excess and known quantity of potassium permanganate. The unused permanganate, determined with a titration using thiosulfate, is used to report the Kappa number, which is directly related to the level of lignin remaining with the pulp.

TABLE 1

Effect of pH on Pulp Mat Kappa Number and Filtrate Absorbance Using Softwood Kraft Pulp and Black Liquor at 71° C.

| pH | Filtrate Absorbence | Kappa Number |
|---|---|---|
| 12 | 11.3 | 57 |
| 11 | 10.5 | 76 |
| 10 | 7.1 | 211 |
| 9 | 4.0 | 271 |

The above results demonstrate that the amount of lignin remaining with the mat (as shown by Kappa number) increases with decreasing pH. The filtrate absorbance decreased as the Kappa number of the mat increased since the lignin, the main color-producing substance in black liquor, remained with the mat instead of the liquid phase. Therefore, filtrate absorbance may be used in place of mat Kappa number to determine where the lignin is, either in the fiber mat or with the liquid phase.

The above experiment was repeated replacing the black liquor with a solution containing 5000 ppm Kraft lignin (Indulin AT, by Westvaco Corp.), 100 ppm $Ca^{+2}$ and enough caustic to raise the pH to 12. The results are found in Table 2.

TABLE 2

Effect of pH on Mat Kappa Number and Filtrate Absorbance Using Kraft Lignin (Indulin AT) at 71° C.

| pH | Absorbence | Kappa Number |
|---|---|---|
| 12 | 2.80 | 13 |
| 9 | 0.38 | 120 |

Table 2 illustrates that the use of Indulin AT is an acceptable model for testing in place of black liquor as the lignin also has a tendency to remain with the fiber when the pH is decreased. The Indulin AT is also more consistent than black liquor, as black liquor may vary with age and sample location.

In order to determine whether the addition of pulp was needed for testing, solutions containing 5000 ppm Indulin AT and 100 ppm $Ca^{+2}$ which did not contain pulp fiber were brought up to pH 12 to dissolve the Indulin AT. The pH was then lowered to the desired level, and the sample was incubated for 30 minutes at the desired temperature. Following incubation, the samples were filtered, and the filtrate brought back up to pH 12 prior to measuring its absorbance at 700 nm.

TABLE 3

Effect of Temperature on Lignin Washability (Filtrate Absorbance vs. pH and Temperature)

| 71° C. | | 50° C. | | 23° C. | |
|---|---|---|---|---|---|
| pH | Blank | pH | Blank | pH | Blank |
| 12.0 | 2.35 | 10.0 | 2.15 | 9.2 | 2.33 |

TABLE 3-continued

Effect of Temperature on Lignin Washability (Filtrate Absorbance vs. pH and Temperature)

| 71° C. | | 50° C. | | 23° C. | |
|---|---|---|---|---|---|
| pH | Blank | pH | Blank | pH | Blank |
| 10.0 | 2.52 | 9.0 | 2.18 | 7.5 | 2.40 |
| 9.8 | 2.52 | 8.5 | 1.24 | 6.5 | 1.46 |
| 9.5 | 0.74 | 8.0 | 0.96 | 6.0 | 0.53 |
| 9.0 | 0.58 | 7.0 | 0.30 | 5.0 | 0.07 |
| 8.0 | 0.27 | 6.0 | 0.16 | 4.0 | 0.07 |

By comparing the results in Table 3 for 71° C. with those of Table 2, it is apparent that the inclusion of the fiber is not necessary to measure the reduction of lignin in the filtrate with decreasing pH.

EXMAPLE 1

Based on the above results, a test method was developed to screen materials in order to determine if they could decrease the tendency of the lignin to be filtered out of solution. The procedure consisted of making a solution of 5000 ppm Indulin AT, 100 ppm $Ca^{+2}$, 1000 ppm treatment actives and enough sodium hydroxide to bring the pH to 12 and dissolve the Indulin AT. The solution pH was then decreased with hydrochloric acid to pH 6 and allowed to incubate at room temperature for 30 minutes prior to filtration. After filtration, the filtrate pH was raised to 12 and the absorbance was measured at 700 nm. The materials used in the following examples are described in Table 4. The taurines (sulfoalkyl amides) and isethionate (sulfoalkyl ester) are available from Rhone Poulenc, Inc., the benzenesulfonate is available from Witco Chemical, and the disulfonate is available from Dow Chemical.

TABLE 4

Products Tested

| Tradename | Description |
|---|---|
| Witconate 1260 | sodium dodecyl benzenesulfonate |
| Dowfax ® 2A1 | alkyl diphenol oxide disulfonate |
| Geropon TN74 | N-methyl-N-palmitoyl-taurine, sodium salt |
| Geropon T33 | N-methyl-N-oleyl-taurine, sodium salt |
| Geropon TC42 | N-methyl-N-(coconut oil)-taurine, sodium salt |
| Geropon TK32 | N-methyl-N-(tall oil acyl)-taurine, sodium salt |
| Geropon AS 200 | coconut acid ester of sodium isethionate |
| Witconate D510 | sodium 2-ethylhexyl sulfate |
| Poly-Tergent ® CS-1 | alkoxylated linear alcohol carboxylic acid |
| Emcol ® CBA50 | poly(oxy-1,2-ethanediyl), -(carboxymethyl)-(tridecyloxy)-branched, sodium salt |
| Emcol CNP120 | poly(oxy-1,2-ethanediyl), -(carboxymethyl)-(nonylphenoxy)-, sodium salt |
| Gafac ® RE610 | polyoxyethylene nonyl phenyl ether phosphate |
| Pluronic ® F108 | ethoxy/propoxy/ethoxy block copolymer |
| Tergitol ® 15-S-7 | secondary alcohol ethoxylate, 7 mole EO |
| Igepal C0530 | nonyl phenol ethoxylate, 6 mole EO, HLB = 10.5 |
| Igepal C0880 | nonyl phenol ethoxylate, 30 mole EO, HLB = 17.2 |
| Floerger ® 45.20 | 80% dimethyldiallyl ammonium chloride (DMDAAC)/20% acrylamide copolymer |
| Goodrite ® K732 | polyacrylate, MW = 5100 |
| Carbopol 941 | polyacrylate, MW = 1,250,000 |
| Foam-Trol ® 275 | defoamer, containing PEG, ethylenebis stearamide, oil and silicone oil |
| Polyox ® N60K | polyethylene oxide, MW = 2,000,000 |

TABLE 5

Effect of Anionic Surfactants (Filtrate Absorbance)

| Material | Absorbence |
|---|---|
| Blank | 0.53 |
| Witconate 1260 | 2.53 |
| Dowfax 2A1 | 2.34 |
| Geropon TN74 | 2.60 |
| Geropon T33 | 2.26 |
| Geropon TC42 | 2.66 |
| Geropon TK32 | 2.65 |
| Geropon AS200 | 1.07 |
| Witconate D510 | 0.87 |
| Polytergent CS1 | 1.05 |
| Emcol CBA50 | 0.32 |
| Emcol CNP120 | 0.18 |
| Gafac RE610 | 2.19 |

The data in Table 5 show that the majority of anionic surfactant types decreased the tendency of lignin to remain with the filter paper (as shown by high liltrate absorbances). The sulfonates were unexpectedly superior to the alkyl sulfate and the carboxylated surfactants.

Table 6 contains the results of using nonionic surfactants as well as typical materials that may be found in brown stock washers. The effect of a combination of alkylphenol ethoxylate and polyacrylate (Igepal C0530/Goodrite K732), a combination taught by Freis et al. U.S. Pat. No. 4,810,328, was also tested at a 1:1 ratio.

TABLE 6

Effect of Other Materials (Filtrate Absorbance)

| Material | Absorbence |
|---|---|
| Blank | 0.53 |
| Pluronic F108 | 0.12 |
| Tergitol 15-S-7 | 0.06 |
| Igepal C0530 | 0.13 |
| Igepal C0880 | 0.13 |
| Floerger 45.20 | 0.03 |
| Polyox N60K | 0.06 |
| Igepal C0530/Goodrite K732 | 0.95 |
| Foamtrol 275 | 1.61 |
| Goodrite K732 | 2.03 |
| Carbopol 941 | 1.59 |

As shown in Table 6, the combination found in Freis et al. '328 gave relatively little improvement as compared with the untreated sample.

EXAMPLE 2

In this example, the same procedure was followed as for Example 1, with the exception that the pH was decreased to various levels in order to determine the pH range where the lignin began staying with the filter paper. Materials which had shown some effect in Example 1 were used for this testing. The results are reported in Table 7.

TABLE 7 pH Range in which Lignin remains with Filter Paper (Filtrate Absorbance)

| | pH | | | | |
|---|---|---|---|---|---|
| Product | 6.0 | 5.5 | 5.0 | 4.5 | 4.0 |
| Untreated | 0.53 | 0.16 | 0.07 | 0.04 | 0.07 |
| Goodrite K732 | 2.03 | 0.98 | 0.25 | | |
| Carbopol 941 | 1.59 | | 0.10 | | |
| Foamtrol 275 | 1.61 | | 0.33 | | |
| Witconate 1260 | 2.53 | 1.50 | 0.22 | | |
| Dowfax 2A1 | 2.34 | | 1.65 | 0.88 | 0.13 |
| Geropon TN74 | 2.60 | | 1.16 | 0.61 | |
| Geropon T33 | 2.26 | | 0.96 | 0.32 | 0.13 |
| Geropon TC42 | 2.66 | | 1.30 | 1.27 | 0.35 |
| Geropon TK32 | 2.65 | 1.95 | 0.87 | 0.17 | |
| Polytergent CS1 | 1.05 | | 0.21 | | |
| Gafac RE610 | 2.19 | 0.31 | 0.09 | | 0.08 |

Table 7 demonstrates the relative ineffectiveness of the polyacrylates, defoamer and surfactants which were carboxylated or phosphated as compared to the sulfonates.

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

I claim:

1. A method for removing lignin and spent cooking chemicals from pulp which comprises adding within the washing operation an amount of from about 0.1 to 1000 parts per million parts pulp of an anionic sulfonate surfactant selected from the group consisting of sodium dodecyl benzenesulfonate, alkyl diphenol oxide disulfonate, sodium N-methyl-N-palmitoyl-taurine, sodium N-methyl-N-oleyl-taurine, sodium N-methyl-N-(coconut oil)-taurine and sodium N-methyl-N-(tall oil acyl)taurine, wherein the removal of lignin and spent cooking chemicals occurs at a temperature of from about 100°–200° F.

2. The method as recited in claim 1 wherein said anionic sulfonate surfactant is sodium N-methyl-N-palmitoyl-taurine.

3. The method as recited in claim 1 wherein said anionic sulfonate surfactant is sodium N-methyl-N-(coconut oil)-taurine.

4. The method as recited in claim 1 wherein said anionic sulfonate surfactant is sodium N-methyl-N-(tall oil acyl)-taurine.

5. The method as recited in claim 1 wherein said anionic sulfonate surfactant is sodium dodecyl benzenesulfonate.

6. The method as recited in claim 1 wherein said anionic sulfonate surfactant is sodium N-methyl-N-oleyl-taurine.

7. The method as recited in claim 1 wherein said anionic sulfonate surfactant an alkyl diphenol oxide disulfonate.

8. The method as recited in claim 1 wherein the removal of lignin and spent cooking chemicals occurs at a pH of from about 8–13.

9. The method as recited in claim 1 wherein the pulp is prepared by chemical, mechanical or semi-chemical means.

* * * * *